United States Patent [19]

Hay

[11] 4,001,903

[45] Jan. 11, 1977

[54] WORKPIECE MANIPULATING DEVICES

[76] Inventor: Robert B. Hay, 100 Appleton St., North Andover, Mass. 01845

[22] Filed: Jan. 22, 1975

[21] Appl. No.: 543,057

[52] U.S. Cl. ..... 7/1 M; 81/3 R; 294/19 R

[51] Int. Cl.[2] ..... B25F 1/00

[58] Field of Search ..... 7/1 M; 145/24, 25; 81/8.1, 3 R; 30/168; 294/19 R, 26, 2

[56] References Cited

UNITED STATES PATENTS

| | | | |
|---|---|---|---|
| 191,643 | 6/1877 | Bowen | 145/24 |
| 192,323 | 6/1877 | Carney | 145/24 |
| 1,308,654 | 7/1919 | Bopst | 7/1 M |
| 2,630,627 | 3/1953 | Beck | 145/24 |

*Primary Examiner*—Al Lawrence Smith
*Assistant Examiner*—Roscoe V. Parker

[57] ABSTRACT

There is disclosed a workpiece manipulating device for use in the manual control of workpieces being operated upon by power tools. The device generally comprises an elongate handle having a triangularly and eccentrically notched working end adapted to engage a workpiece. The device provides the power tool operator with the ability to safely and accurately manipulate workpieces of different thicknesses.

10 Claims, 2 Drawing Figures

WORKPIECE MANIPULATING DEVICES

FIELD OF THE INVENTION

The present invention relates generally to safety devices for use in conjunction with operations of diverse power tools and is more specifically concerned with workpiece manipulating devices adapted to provide facility in the manual control of workpieces while maintaining the operator's manipulating hand(s) safely remote from hazard.

The operations of many power tools, such as table mounted saws, jointers, bandsaws, planers, sanders, slitters, routers and the like, generally involves manual control and feed of a workpiece into the workpiece altering mechanism thereof. This, of course, constitutes an inherent safety hazard and accidental injuries to fingers, hands and arms resulting from the direct manual control of workpieces are often of an extremely serious and debilitating nature. On the other hand, if accurate control of the workpiece is deficient, other problems arise, not the least of which can be a diminution of the ability to maintain prescribed dimensional tolerances in the desired alteration of the workpiece. Too, in operations of certain power tools such as table saws, failure to maintain precise control of the workpiece fed into the circular blade spinning against the direction of feed can lead to another hazardous phenomenon, known within the art as "kick-back". Here, the partially or fully cut workpiece is, incident to defective control thereof, accidentally momentarily bound against the spinning blade or is pinched between said blade and the saw guide or fence, thereby causing the workpiece or portion thereof to be forcefully propelled backward in the direction of the operator.

It is known practice in the art to employ a length of scrap stock as a so-called "push stick" to ameliorate the hazards involved in operations of bench or table mounted power tools. Unfortunately, for many operations, such push sticks generally do not provide adequate controllability of the workpiece. In accordance with the present invention, however, this problem has been substantially completely overcome.

OBJECTS OF THE INVENTION

It is a principal object of the invention to provide a novel workpiece manipulating device.

It is another object of the invention to provide a workpiece manipulating device having improved workpiece controllability characteristics.

It is yet another object of the invention to provide a workpiece manipulating device adaptable for use with workpieces of varying thickness.

Other objects and advantages of the present invention will in part be obvious and will in part appear hereinafter.

GENERAL DESCRIPTION OF THE INVENTION

The workpiece manipulating device of the invention broadly comprises an elongate handle one end of which defines a hand grip and the other end of which comprises a laterally flattened working end. The terminus of the working end is triangularly notched to provide workpiece gripping points.

THE DRAWINGS

A better understanding of the structure and functions of the present invention can be had by reference to the drawings forming part hereof wherein;

FIG. 1 is a schematic, diagrammatic top view of a workpiece manipulating device of the invention, and FIG. 2 is a schematic, diagrammatic perspective view of another embodiment of the workpiece manipulating device of the invention.

DESCRIPTION OF PREFERRED EMBODIMENTS

Figure 1:
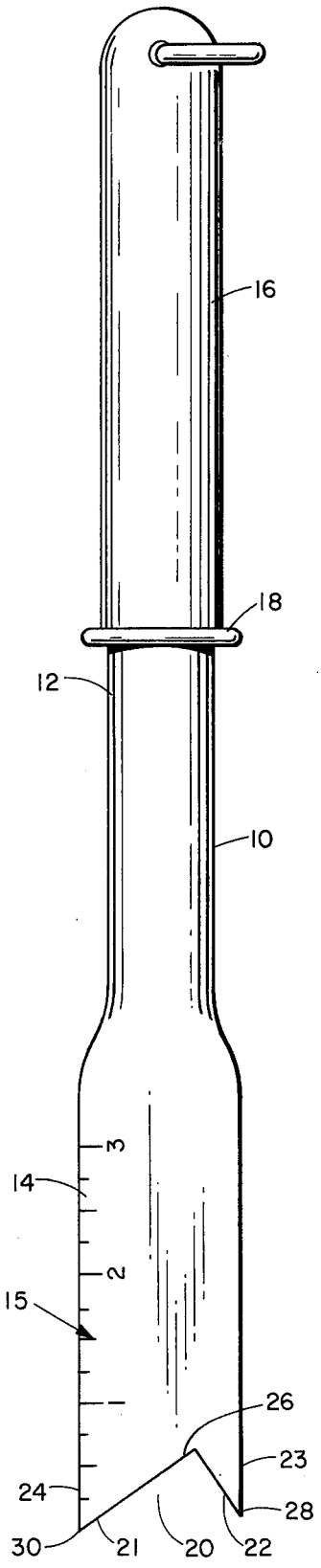

Referring now specifically to FIG. 1, the workpiece manipulating device of the invention comprises an elongate handle 10, one end of which defines a hand grip end 12 and the other end of which is provided with a laterally flattened working end portion 14. Desirably, the hand grip end 12 of handle 10 will be provided with a polymeric hand grip 16 which may be composed of any suitable polymeric substance. In a further preferred embodiment, the hand grip 16 will also comprise a flange or pommel 18 extending outwardly from the lower margin thereof. Said flange or pommel 18, of course, serves to mitigate against accidental slippage of the operator's hand downwardly along the handle 10 towards the working end 14 of the device.

The laterally flattened working end portion 14 is provided with a trangular notch 20 at the terminus thereof. Adjacent sides 21 and 22 of said triangular notch 20 extend inwardly and upwardly from each of the lateral margins 23 and 24 of flattened working end portion 14 and meet within said working end portion to define an apex 26. By this arrangement, said triangular notch 20 provides terminally located sharp points 28 and 30 positioned on either side of the working end portion 14. In a much preferred embodiment of the invention, the apex 26 of the angle defined between said inwardly and upwardly extending adjacent sides 21 and 22 of the triangular notch 20 will be located substantially to one side or the other of the geometric centerline of laterally flattened working end portion 14. By virtue of said eccentric location of said apex 26, the adjacent sides 21 and 22 of the triangular notch 20 will be of substantially different lengths and will provide substantially improved adaptability of the manipulating device for controlling workpieces of varying thickness. Thus, where the workpiece is relatively thin, the manipulating device of the invention can be readily and effectively employed by application of points 28 and 30 thereof to the top surface of the workpiece. Said points obtain purchase into the surface of said workpiece and thus operate as the principal gripping elements of the arrangement. Where the thickness of the workpiece is sufficient, however, the manipulating device of the invention may be employed with the plane of the flattened working end portion 14 thereof held substantially normal to the plane of the workpiece, thereby to directly engage the workpiece in triangular notch 20 with the shorter side 22 thereof down. Where the workpiece is of substantial thickness, the manipulating device may again be employed with the plane of flattened working end portion 14 normal to the plane of the workpiece so as to directly engage the workpiece in notch 20. However, in this instance, the manipulating device may be held with the longest side 21 of notch 20 down. Thus, by location of apex 26 substantially to one side or the other of the centerline of working end portion 14, there is provided a workpiece engaging structure of substantial flexibility in the manner of use thereof and of substantial adaptability in effectively accommodating workpieces of different thicknesses. These benefits supplement the safety goals of the invention since they provide for accurate manipulation of workpieces of substantially different thickness with comfort and without requiring the tool operator to assume dangerously awkward positions in the use of the manipulating device. In another preferred embodiment of the invention, the included angle of apex 26 formed between the adjacent sides of the triangular notch 20 will generally approximate a right angle.

While the above description has been based, for purposes of clarity, upon the use of a single manipulating device, it is obvious that the manipulating device of the invention can also be used to advantage in pairs. In this case one of the devices can be utilized primarily to provide linear control of the workpiece fed to the power tool while the other can be utilized principally to provide lateral control of the workpiece.

Where, as in yet another preferred embodiment of the invention, the elongate handle 10 is formed of a tubular metallic material such as aluminum or alloys thereof, the flattened working end portion 14 can be conveniently and readily integrally formed by squeezing or pressing together the walls of a suitable length of the working end of tubular handle 10.

In a further preferred embodiment of the invention, there can be provided a suitably graduated scale 15 running along the handle 10 and extending upwardly from the terminus of flattened working end portion 14 thereof. Said scale 15 may be conveniently employed to set saw blade or tool height, measure stock dimensions, and the like.

Generally speaking, the requirements of the materials of construction employed in fabrication of the manipulating devices of the invention will be obvious and require no extensive elaboration herein. Specifically, it is obvious that handle 10 should be of rigid construction. Accordingly, said handle 10 can be fabricated of conventional materials of construction such as hardwood or a structural metal. Bearing in mind the service task to which the flattened end portion 14 of the device is to be put, however, it is highly desirable that at least that portion thereof likely to come into contact at some time during its service life with a saw blade, planer head or other operating tool modality be constructed of a material which would not cause serious damage to the power tool and, at the same time, be itself readily repaired, such as by filing, should such accidental contact be experienced. Accordingly, rigid, relatively soft and easily worked metallic and polymeric materials such as aluminum, brass, magnesium, aluminum alloys, magnesium alloys, rigid polyamide compositions, rigid acrylonitrile-butadiene-styrene polymer compositions, hard rubber and the like are preferred. Of these, aluminum and aluminum alloys are generally preferred as the material of construction of the handle 10 and the working end portion 14, taken severally or in combination.

Figure 2:
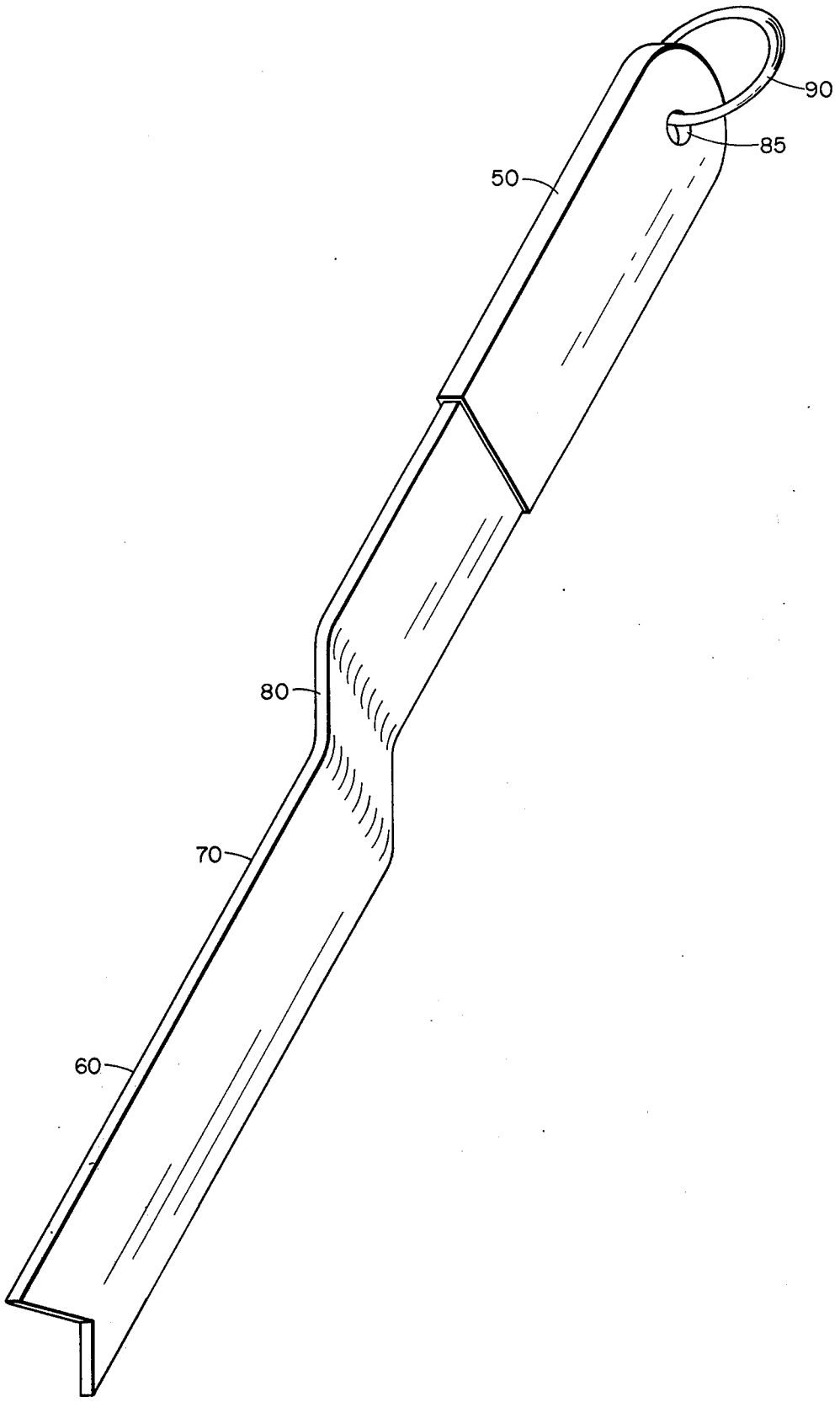

In the embodiment of FIG. 2, the workpiece manipulating device of the invention is disclosed to be integrally formed from a single piece of a plate form of bar stock metallic material. Elongate handle 70 comprises a vertical off-set 80 intermediate the hand grip 50 and working end portion 60. Said vertical off-set 80 constitutes another preferred embodiment of the invention serving to mitigate against accidental slippage of the operator's hand downwardly along the handle 70 while also providing additional flexibility in the use of the device, particularly with respect to the choice of angle at which said device is held in manipulating a given workpiece. In addition, said vertical off-set also tends to position the operator's hand above the working end portion 60, thereby the further remove the hand from the zone of danger.

An additional desirable feature resides in the provision of an aperture 85 through the end portion of hand grip 50. A ring 90 can also be provided through said aperture 85 and, taken singly or in combination, said aperture and/or said aperture/ring assembly, can be employed for hanging of the manipulating device of the invention in a convenient storage location.

While this invention has been described with respect to certain embodiments thereof, it is not intended to be so limited. It should be understood, therefore, that variations and modifications of the invention may be made which are obvious to those skilled in the art without departing from the essential spirit or intended scope thereof.

I claim:

1. A workpiece manipulating device comprising an elongate handle, the upper end of which defines a hand grip and the lower end of which comprises a laterally flattened working end portion composed of a rigid and relatively soft material, the terminus of said working end portion having a triangular notch extending upwardly and inwardly from the respective lateral margins thereof, the angle defined between the adjacent sides of said triangular notch being essentially a right angle and the apex thereof being located substantially to one side of the lateral centerline of said working end portion.

2. The workpiece manipulating device of claim 1 wherein said elongate handle comprises a vertical off-set intermediate said working end and said hand grip end.

3. The workpiece manipulating device of claim 1 wherein said elongate handle is a metal tube and wherein said laterally flattened working end portion is formed by compressing together the tube walls of the working end of said metal tube.

4. The workpiece manipulating device of claim 1 wherein said elongate handle and said laterally flattened working end portion are integrally formed from a plate form metallic material.

5. The workpiece manipulating device of claim 1 wherein said laterally flattened working end portion is composed of aluminum or an aluminum alloy.

6. The workpiece manipulating device of claim 1 wherein said laterally flattened working end portion and said elongate handle are composed of aluminum or an aluminum alloy.

7. The workpiece manipulating device of claim 1 wherein said hand grip end of said elongate handle is provided with a polymeric hand grip.

8. The workpiece manipulating device of claim 7 wherein said polymeric hand grip comprises a pommel.

9. The workpiece manipulating device of claim 1 wherein said hand grip end comprises an aperture therethrough.

10. The workpiece manipulating device of claim 1 wherein there is provided a graduated scale running upwardly from the terminus of said flattened working end portion.

* * * * *